United States Patent [19]

Haselkorn et al.

[11] 4,367,101

[45] Jan. 4, 1983

[54] METHOD OF PROVIDING AN ANTI-STICK COATING ON NON-ORIENTED, SEMI-PROCESSED ELECTRICAL STEELS TO BE SUBJECTED TO A QUALITY ANNEAL

[75] Inventors: Michael H. Haselkorn, Franklin; James D. Evans, Middletown, both of Ohio

[73] Assignee: Armco Inc., Middletown, Ohio

[21] Appl. No.: 251,136

[22] Filed: Apr. 6, 1981

[51] Int. Cl.[3] ..... C23F 7/10

[52] U.S. Cl. ..... 148/113; 148/6.15 R; 148/6.15 Z; 148/6.16; 148/122; 148/121; 106/286.5

[58] Field of Search ..... 148/113, 121, 122, 6.15 R, 148/6.16, 6.15 Z; 106/286.15

[56] References Cited

U.S. PATENT DOCUMENTS

| | | | |
|---|---|---|---|
| 3,138,492 | 6/1964 | Perry et al. | 148/6.15 |
| 3,421,949 | 1/1969 | Halversen | 148/6.2 |
| 3,528,863 | 9/1970 | Foster et al. | 148/113 |
| 3,720,549 | 3/1973 | Hirst et al. | 142/6.16 |
| 3,867,211 | 2/1975 | Easton | 148/121 |
| 3,948,786 | 4/1976 | Evans | 148/122 |
| 3,996,073 | 12/1976 | Evans | 148/113 |
| 4,190,468 | 2/1980 | Kitayama et al. | 148/12 A |

*Primary Examiner*—Veronica O'Keefe
*Attorney, Agent, or Firm*—Frost & Jacobs

[57] ABSTRACT

A process of providing an inorganic anti-stick coating directly on non-oriented, semi-processed electrical steels by applying to such steels a coating solution containing $Al^{+++}$, $Mg^{++}$, and $H_2PO_4^-$ in a specified relative relationship, the concentration of $Al^{+++}$, $Mg^{++}$, and $H_2PO_4^-$ comprising 100 parts by weight calculated as $Al_2O_3$, MgO and $H_3PO_4$, respectively, on a water-free basis. The coating solution may additionally contain from 0 to 150 parts by weight of colloidal silica on a water-free basis. Chromic anhydride ($C_rO_3$) may be added to the coating solution to improve its wettability and improve the moisture resistance of the anti-stick coating. The coating solution is so diluted with water as to provide a uniform coating as thin as possible to prevent lamination sticking and having a coating weight of less than 2 grams per square meter on each side. The coated electrical steel is subjected to a heat treatment to cure the anti-stick coating thereon.

10 Claims, No Drawings

METHOD OF PROVIDING AN ANTI-STICK COATING ON NON-ORIENTED, SEMI-PROCESSED ELECTRICAL STEELS TO BE SUBJECTED TO A QUALITY ANNEAL

TECHNICAL FIELD

The invention relates to improved inorganic anti-stick coatings for metallic surfaces such as the surfaces of non-oriented, semi-processed electrical steels, and more particularly to such anti-stick coatings which will withstand quality annealing temperatures up to at least about 1650° F. (900° C.); which will produce hard, thin coatings of excellent and uniform appearance; and which will prevent lamination sticking.

BACKGROUND ART

The anti-stick coatings of the present invention can be applied to any metal surface to prevent sticking during an annealing operation or to limit oxidation during an annealing operation.

A primary use for the anti-stick coatings of the present invention is their application to cold rolled, non-oriented, semi-processed silicon steels of which there are a number of well known ASTM standard grades. While not intended to be so limited, the anti-stick coatings will be described with respect to this use for purposes of an exemplary embodiment.

The term "non-oriented, semi-processed electrical steels", as used herein and in the claims, is intended to refer to those electrical steels known in the art as "semi-processed" since they have not been processed at the mill to fully develop magnetic properties. The customer must complete the processing by proper annealing. This necessary annealing (generally known in the art as a "quality anneal") involves grain growth and decarburization (depending upon the amount of decarburization accomplished in the mill), both of which are essential to development of optimum magnetic properties.

Such steels include cold rolled, non-oriented, semi-processed silicon steels; cold rolled, semi-processed carbon steels for motor laminations and the like; and semi-processed, low-oxygen silicon bearing lamination steels of the type taught in U.S. Pat. No. 3,867,211.

In the usual practice, the customer forms laminations for motors, transformers or the like from this cold rolled, non-oriented, semi-processed silicon steel. As indicated above, it is essential that these laminations be subjected to a quality anneal to develop optimum magnetic properties of the laminations. The quality anneal is usually conducted in a decarburizing atmosphere containing water vapor, such as hydrogen, hydrogen-nitrogen, or an atmosphere formed by partial combustion of gas. The quality anneal is usually conducted at a temperature within the range of from about 1400° F. (760° C.) to 1600° F. (870° C.) Temperatures at the upper end of this range tend to produce somewhat improved magnetic properties.

A major problem encountered during a quality anneal is that of adhesion or sticking of the laminations. Prior art workers have developed a number of different coatings which can be applied to the steel at the plant and which tend to prevent sticking of the laminations during the quality anneal.

For example, an electrolytic magnesium hydroxide coating was developed to prevent lamination sticking during a quality anneal at a temperature of from about 1400° F. (760° C.) to about 1600° F. (870° C.). Such a coating, however, was characterized by a number of problems. It was expensive to use and excess magnesia remained on the laminations after the quality anneal. This created dust and handling problems. The excess magnesia also got into the lubricant used during punching. If allowed to accumulate, this excess magnesia caused die wear problems. Finally, the magnetic quality of laminations provided with this coating was impaired.

Another exemplary anti-stick coating comprised a coating solution of 75% phosphoric acid diluted 8 to 1 with water and dried in a furnace at from about 1000° F. (538° C.) to about 1100° F. (593° C.), actual strip temperature of from about 700° F. (371° C.) to about 800° F. (427° C.). It was only necessary for the coating to achieve a temperature of from about 700° F. (371° C.) to about 800° F. (427° C.). Soaking for any length of time at temperature was not required.

This exemplary phosphoric acid anti-stick coating was used at quality anneal temperatures of from about 1450° F. (788° C.) to about 1550° F. (843° C.). The present day typical quality anneal temperatures are from about 1200° F. (649° C.) to about 1600° F. (870° C.). At temperatures above about 1500° F. (816° C.) this phosphoric acid anti-stick coating begins to decompose and cannot protect the surface of the steel from oxidation. For this reason, lamination sticking becomes a problem.

The present invention is based on the discovery that greatly improved anti-stick coatings can be formed from coating solutions taught in U.S. Pat. Nos. 3,948,786 and 3,996,073 for use in producing insulative coatings for electrical steels, when these coating solutions are so diluted as to provide a uniform coating as thin as possible to prevent lamination sticking and having a coating weight of less than 2 grams per square meter on each side. The coating solutions are applied to the cold rolled, non-oriented semi-processed silicon steel at the mill by any appropriate means and are cured by an appropriate heat treatment.

The resulting anti-stick coating constitutes a thin, hard coating which will not decompose during a quality anneal conducted at a temperature of up to at least 1650° F. (900° C.). Because the improved anti-stick coatings do not decompose during a quality anneal conducted at the higher temperatures and prevent lamination sticking, a number of additional benefits are obtained. For example, the improved anti-stick coatings act as nitrogen and oxygen diffusion barriers, preventing nitrogen pick-up and surface oxidation from occurring during the quality anneal. The reduction in surface oxidation not only produces laminations with improved physical appearance after the quality anneal, but also results in laminations having improved high induction magnetic properties. The anti-stick coatings of the present invention offer some rust protection to the laminations both prior to and after the quality anneal. The anti-stick coatings do not prevent decarburization from occurring during the quality anneal. By way of additional advantages, the anti-stick coatings of the present invention, since they prevent surface oxidation, enable the use of faster heating rates and/or higher temperatures. This results in increased productivity, or improved magnetic quality, or both. Further, the coatings can be punched without causing excessive die wear or chipping, are easily welded, and enable the annealed laminations to be handled by automatic stacking machines.

DISCLOSURE OF THE INVENTION

According to the invention there is taught a process of providing an inorganic anti-stick coating directly on non-oriented, semi-processed electrical steels by applying to such steels a coating solution containing $Al^{+++}$, $Mg^{++}$ and $H_2PO_4^-$ in a specific relative relationship, the concentration of $Al^{+++}$, $Mg^{++}$, and $H_2PO_4^-$ comprising 100 parts by weight calculated as $Al_2O_3$, MgO and $H_3PO_4$, respectively, on a water free basis.

The coating solution may contain from 0 to 150 parts by weight of colloidal silica on a water free basis. In addition, chromic anhydride ($C_rO_3$) may be added to improve the wettability of the coating solution and to improve the moisture resistance of the anti-stick coating formed therefrom. The coating solution is so diluted as to provide a uniform coating as thin as possible to prevent lamination sticking and having a coating weight of less than 2 grams per square meter on each side. In a preferred embodiment, colloidal silica is present in an amount of 50 parts by weight on a water free basis.

The coating solution is applied to the non-oriented, semi-processed electrical steel in any appropriate manner and is subjected to a heat treatment to cure the anti-stick coating thereon.

DETAILED DESCRIPTION OF THE INVENTION

As indicated above, U.S. Pat. Nos. 3,948,786 and 3,996,073 teach coating solutions which, upon heat curing, will form improved insulative coatings for electrical steels. It has been discovered that these same coating solutions, diluted to form a uniform coating as thin as possible, will form superior anti-stick coating on cold rolled, non-oriented, semi-processed electrical steels when applied thereto and heat cured. The teachings of U.S. Pat. Nos. 3,948,786 and 3,996,073 are incorporated herein by reference. According to these patents, the coating solution (in the absence of collodial silica) contain $Al^{+++}$, $Mg^{++}$ and $H_2PO_4^-$ in the following relative relationship on a water free basis: from 3 to 11% by weight $Al^{+++}$ calculated as $Al_2O_3$, 3 to 15% $Mg^{++}$ calculated as MgO and from 78 to 87% by weight $H_2PO_4^-$ calculated as $H_3PO_4$. The total weight percent of these compounds is 100 on a water free basis. The $Al^{+++}$, $Mg^{++}$ and $H_2PO_4^-$ concentration may be achieved through the use of appropriate combinations of compound that will place these ions in solution (e.g. aluminum phosphates, aluminum hydroxide, magnesium phosphate, magnesia, magnesium hydroxide, phosphoric acid and the like).

A collodial silica solution may be added to the aluminum-magnesium-phosphate solution. If the concentration of $Al^{+++}$, $Mg^{++}$ and $H_2PO_4^-$ (again calculated as $Al_2O_3$, MgO and $H_3PO_4$, respectively) comprises 100 parts by weight on a water-free basis, the colloidal silica will comprise from 0 to 150 parts by weight on a water-free basis.

When colloidal silica is present in the solution, a particular relationship between $Al^{+++}$, $Mg^{++}$, $H_2PO_4^-$ and colloidal silica ($SiO_2$) must be maintained on a water-free basis. On this basis, $Al^{+++}$, $Mg^{++}$ and $H_2PO_4^-$ are again calculated as $Al_2O_3$, MgO and $H_3PO_4$, respectively. The silica content may vary from 0 to 60% by weight of the $Al_2O_3$, MgO, $H_3PO_4$, $SiO_2$ system on a water-free basis.

As calculated on a water-free basis, the weight percents of $Al^{+++}$ (as $Al_2O_3$), $Mg^{++}$ (as MgO) and $H_2PO_4^-$ as ($H_2PO_4$) will depend upon the $SiO_2$ content by the following formulae:

$$\text{Weight percent } Al^{+++}(\text{as } Al_2O_3) = [3 \text{ to } 11\%](100\% = SiO_2/100\%)$$

$$\text{Weight percent } Mg^{++}(\text{as MgO}) = [3 \text{ to } 15\%](100\% - SiO_2/100\%)$$

$$\text{Weight percent } H_2PO_4^-(\text{as } H_2PO_4) = [78 \text{ to } 87\%](100\% - SiO_2/100\%)$$

where the total weight percent of $SiO_2$, $Al^{+++}$ (as $Al_2O_3$), $Mg^{++}$ (as MgO) and $H_2PO_4^-$ (as $H_2PO_4$) is equal to 100.

The colloidal silica solution preferably comprises about 20 to 40% by weight colloidal silica, the balance being water. Collodial silica solutions meeting this specification are commercially available. The composition of the colloidal silica solution may have a bearing on the shelf-life of the coating solution of the present invention. Excellent results have been achieved through the use of LUDOX TYPE AS, sold by E. I. DuPont De Nemours & Co., Inc., Industrial Chemicals Department, Industrial Specialties Division, Wilmington, Del. 19898. LUDOX is a registered trademark of E. I. Du Pont De Nemours & Co., Inc. Excellent results have also been achieved through the use of NALCOAG-1034A, sold by Nalco Chemical Co., Chicago, Ill. NALCOAG is a registered trademark of Nalco Chemical Co.

The coating solutions of the present invention may be applied to the non-oriented, semi-processed electrical steel in any suitable manner such as spraying, dipping or swabbing. Metering rolls and doctor means may also be used. It will be understood that the semi-processed electrical steel to be coated should be free of oils, greases and scale.

The coating solutions of the present invention should be so diluted with water as to provide a uniform coating as thin as possible to prevent lamination sticking and having a coating weight of less than 2 grams per square meter on each side and preferably less than 1 gram per square meter on each side. Above about 2 grams per square meter on each side punching and/or welding problems may occur. Below about 0.1 gram per square meter on each side, obtaining a continuous coating may be difficult. Typical insulative coatings of the type taught in U.S. Pat. No. 3,948,786 have a coating weight of about 8 grams per square meter per side. The amount of dilution will depend upon the manner in which the coatings are applied to the non-oriented, semi-processed electrical steel. The skilled worker in the art, having selected a mode of application, can by routine experimentation determine the proper amount of dilution to achieve the desired anti-stick coating. While the coatings of the present invention may provide a small amount of surface insulation, they are not insulative coatings as are those taught in the above mentioned U.S. Pat. No. 3,948,786 and 3,996,073.

Once a coating solution of the present invention has been applied to the non-oriented, semi-processed electrical steel, the steel is subjected to a heat treatment to dry or cure the coating solution thereon to form the desired anti-stick coating. The coating solution is applied to the electrical steel with the electrical steel being at room temperature, or at a temperature below the boiling point of the solution. The heat treatment to cure or dry the solution is accomplished at a strip temperature of from about 700° F. (371° C.) to about 1600° F.

(870° C.) and preferably from about 800° F. (427° C.) to about 850° F. (454° C.). The heat treatment is conducted in any appropriate atmosphere such as air (if below about 1200° F. or 649° C.), nitrogen, hydrogen or nitrogen-hydrogen mixtures. The heat treatment is conducted for a period of time sufficient to dry and cure the coating solution on the electrical steel. The coating must not be "fired" using very reducing conditions or flaking from the steel surface after firing will result.

While not required, chromic anhydride ($C_rO_3$) may be added in an amount of from about 10 to 45 parts by weight for every 100 parts by weight of $H_2PO_4^-$ calculated as $H_3PO_4$ in the solution.

EXAMPLE 1

Twenty four parallel and twenty four cross-grain Epstein samples were sheared from a 26 gauge M-43 semi-processed coil and were randomly placed into three groups consisting of 8 parallel and 8 cross-grain Epstein samples. One group of samples was coated with the previously described prior art coating solution of 75% phosphoric acid diluted 8 to 1 with water to produce a very thin continuous coating. A second group was coated with an anti-stick coating of the present invention. This coating contained 46.4% $SiO_2$, 45.3% $H_3PO_4$, 3.6% MgO and 4.7% $Al_2O_3$ on a water-free basis. In addition, $C_rO_3$ was added in an amount of 25 grams of $C_rO_3$ per 100 grams of $H_3PO_4$ in the solution. The coating solution contained $SiO_2$ in an amount of 50% by weight of the $Al_2O_3$, MgO, $H_3PO_4$, $SiO_2$ system on a water-free basis. The solution was diluted to produce a continuous coating having a coating weight of about 0.75 gram per square meter per side on the electrical steel. The third set of Epstein samples received no treatment.

The first set of Epstein samples was heat treated in a furnace to cure the coating at a temperature of about 800° F. (427° C.) for a period of 30 seconds in an atmosphere of air. Similarly, the second set of Epstein samples was heat treated in a furnace to cure the coating at a temperature of about 800° F. (427° C.) for a period of 30 seconds in an atmosphere of air.

All three sets of Epstein samples were then quality annealed at 1600° F. (870° C.) for one hour in an 80% nitrogen, 20% hydrogen atmosphere having a dew point of +110° F. After the quality anneal, the magnetic quality, amount of surface oxidation and percent of carbon and nitrogen for the samples were determined. The magnetic quality of the samples is summarized in TABLE I below:

TABLE I

| Samples | Corrected Core Loss B = 1.0T | Corrected Core Loss B = 1.5T | Peak Permeability B = 1.5 | Peak Permeability H = 796 | Inductance Permeability B = .7 | Inductance Permeability B = .01 |
|---|---|---|---|---|---|---|
| Group 1 | .651 | 1.538 | 1531 | 1501 | 17,260 | 2254 |
| Group 2 | .643 | 1.520 | 1551 | 1503 | 17,655 | 2135 |
| Group 3 | .663 | 1.570 | 1423 | 1495 | 16,940 | 2200 |

All core loss values are stated in watts per pound and were corrected to 17.7 mils.

The Franklin Resistivity currents of the Groups of Samples, after the quality anneal, were as follows: Group 1=0.872 amps, Group 2=0.660 amps and Group 3=0.955 amps by the Surface Insulation Test Method ASTM A717-75.

All of the samples of all of the Groups demonstrated a final carbon of less than 0.0015 weight percent. Both the samples of Group 1 and Group 2 demonstrated better magnetic qualities than those of Group 3. The magnetic qualities of the Epstein samples coated with the anti-stick coating of the present invention (Group 2) were better than the magnetic qualities of the Epstein samples coated with the prior art anti-stick coating (Group 1). The Epstein samples of Group 2 had significantly lower Franklin currents, compared to the Epstein samples of the other groups. This indicates that the improved anti-stick coating of the present invention still remained on the surface of the Epstein samples after the quality anneal. Finally, no sample sticking occurred with respect to those samples coated with the anti-stick coating of the present invention (Group 2). Significant sticking was noted with respect to the samples of the other two groups (Groups 1 and 3).

EXAMPLE 2

Samples were taken in the same manner described with respect to Example 1 from a 26 gauge M-43 semi-processed electrical steel coil. The samples were arranged in groups in the same fashion and Group 1 samples were coated with the same prior anti-stick coating, Group 2 samples were coated with the same anti-stick coating of the present invention, again having a coating weight of 0.75 gram per square meter per side. The Group 3 samples were uncoated. In this test, the quality anneal was conducted for 1 hour at 1550° F. (843° C.) in an Exogas atmosphere having a 7:1 air to gas ratio with a dew point of +88° F. All of the sample groups were tested for magnetic qualities and a summary of the results is set forth in Table II below.

TABLE II

| Samples | Corrected Core Loss B = 1.0T | Corrected Core Loss B = 1.5T | Peak Permeability B = 1.5 | Peak Permeability H = 796 | Inductance Permeability B = .01 | Inductance Permeability B = .7 |
|---|---|---|---|---|---|---|
| Group 1 | .700 | 1.653 | 1658 | 1508 | 1743 | 15,602 |
| Group 2 | .675 | 1.592 | 1700 | 1510 | 1868 | 17,162 |
| Group 3 | .712 | 1.700 | 1421 | 1495 | 1673 | 16,293 |

All core loss values are corrected to 17.7 mils and are set forth in watts per pound. Again, those samples coated with the anti-stick coating of the present invention (Group 2) demonstrated improved magnetic quality as compared to those samples of Groups 1 and 3. No sticking of the Epstein samples of Group 2 occurred, while severe sticking was noted with the samples of Groups 1 and 3.

An examination of the cross sectional photomicrographs of an Epstein sample from each of Groups 1, 2 and 3 showed a large amount of surface oxidation had occurred during the quality anneal on both the samples of Group 1 and the samples of Group 3. No additional surface oxidation occurred during the quality anneal on the samples of Group 2, coated with the anti-stick of the present invention.

Modification may be made in the invention without departing from the spirit of it. As indicated above, the coatings of the present invention can be applied to any metal surface to prevent sticking during an annealing operation or to provide a small amount of surface insulation. For example, coatings of the present invention have been applied to aluminum parts to improve surface insulation resistance.

What is claimed is:

1. A process of providing an anti-stick coating directly on non-oriented, semi-processed electrical steels chosen from the class consisting of cold rolled, non-oriented, semi-processed silicon steels, cold rolled, semi-processed carbon steels for motor laminations; and semi-processed, low-oxygen silicon bearing lamination steels, to prevent sticking together of laminations during a quality anneal, comprising the steps of applying to said steel a coating solution containing an $Al^{+++}$, $Mg^{++}$ and $H_2PO_4^-$ concentration in the following relative relationship on a water free basis: from 3 to 11% by weight $Al^{+++}$ calculated as $Al_2O_3$, from 3 to 15% by weight $Mg^{++}$ calculated as MgO and from 78 to 87% by weight $H_2PO_4^-$ calculated as $H_3PO_4$, the total weight percentage of $Al^{+++}$ (as $Al_2O_3$), $Mg^{++}$ (as MgO) and $H_2PO_4^-$ (as $H_3PO_4$) being 100 on a water-free basis, said concentration of $Al^{+++}$, $Mg^{++}$ and $H_2PO_4^-$ comprising 100 parts by weight calculated as $Al_2O_3$, MgO and $H_3PO_4$ respectively on a water-free basis, and from 0 to 150 parts by weight of colloidal silica on a water-free basis, said solution being diluted with water so as to form a uniform coating having a coating weight of less than 2 grams per square meter on each side of said steel, and subjecting said coated steel to a heat treatment at a temperature of from 700° F. (371° C.) to about 1600° F. (870° C.).

2. The process claimed in claim 1 including the step of adding to said solution from about 10 to about 45 parts by weight of chromic anhydride for every 100 parts by weight of $H_2PO_4^-$ calculated as $H_3PO_4$ in said solution.

3. The process claimed in claim 1 wherein said colloidal silica is present in an amount of from about 50 parts by weight to about 100 parts by weight on a water-free basis.

4. The process claimed in claim 1 wherein said heat treatment is conducted at a temperature of from about 800° F. to about 850° F.

5. The process claimed in claim 1 wherein said solution is diluted with water so as to form a uniform coating having a coating weight of less than 1 gram per square meter on each side of said steel.

6. The process claimed in claim 3 including the step of adding to said solution from about 10 to about 45 parts by weight of chromic anhydride for every 100 parts by weight of $H_2PO_4^-$ calculated as $H_3PO_4$ in said solution.

7. The process claimed in claim 3 wherein said heat treatment is conducted at a temperature of from about 800° F. to about 850° F.

8. The process claimed in claim 3 wherein said solution is diluted with water so as to form a uniform coating having a coating weight of less than 1 gram per square meter on each side of said steel.

9. A non-oriented, semi-processed electrical steel having an anti-stick coating made by the process of claim 1.

10. A non-oriented, semi-processed electrical steel having an anti-stick coating made by the process of claim 3.

* * * * *